US007799151B2

(12) United States Patent
Folkman et al.

(10) Patent No.: US 7,799,151 B2
(45) Date of Patent: Sep. 21, 2010

(54) METHOD FOR SURFACE COOLING STEEL SLABS TO PREVENT SURFACE CRACKING, AND STEEL SLABS MADE BY THAT METHOD

(75) Inventors: Cache Folkman, Bettendorf, IA (US); Ambrose Cooke, Davenport, IA (US); Andrew P. Goodman, Bettendorf, IA (US)

(73) Assignee: SSAB Enterprises, LLC, Lisle, IL (US)

( * ) Notice: Subject to any disclaimer, the term of this patent is extended or adjusted under 35 U.S.C. 154(b) by 0 days.

(21) Appl. No.: 12/085,559

(22) PCT Filed: Nov. 25, 2005

(86) PCT No.: PCT/US2005/042555

§ 371 (c)(1),
(2), (4) Date: May 23, 2008

(87) PCT Pub. No.: WO2007/061412

PCT Pub. Date: May 31, 2007

(65) Prior Publication Data

US 2009/0101245 A1 Apr. 23, 2009

(51) Int. Cl.

| | |
|---|---|
| ***C21D 8/02*** | (2006.01) |
| *C22C 38/00* | (2006.01) |
| *B22D 11/12* | (2006.01) |

(52) U.S. Cl. ..... 148/541; 148/320; 164/263

(58) Field of Classification Search ..... 148/541, 148/320; 164/263

See application file for complete search history.

(56) References Cited

U.S. PATENT DOCUMENTS

| | | | | |
|---|---|---|---|---|
| 5,529,486 | A | 6/1996 | Bricmont | |
| 5,544,408 | A | 8/1996 | Tippens et al. | |
| 5,808,891 | A | 9/1998 | Lee et al. | |
| 5,915,457 | A | 6/1999 | Pleschiutschnigg | |
| 6,374,901 | B1 | 4/2002 | Frank et al. | |
| 6,557,622 | B2 | 5/2003 | Frank et al. | |
| 2002/0104597 | A1 * | 8/2002 | Frank et al. | 148/541 |

FOREIGN PATENT DOCUMENTS

| | | |
|---|---|---|
| JP | 07-251265 | 10/1995 |

OTHER PUBLICATIONS

ASM handbooks. vol. 9, Physical Metallurgy Concepts in Interpretation of Microstructures Debbie Aliya, Aliya Analytical, Inc.; Steve Lampman, ASM International "Transformation Kinetics" p. 2, Fig. 39 (a-d).*

Canadian Intellectual Property Office, Office Action dated Oct. 28, 2009 issued for Canadian Patent Application No. 2,630,677 (Cooling Steel Slabs to Prevent Surface Cracking), 2 pages.

* cited by examiner

*Primary Examiner*—Jessica L Ward
*Assistant Examiner*—Alexander Polyansky
(74) *Attorney, Agent, or Firm*—Greenberg Traurig, LLP

(57) ABSTRACT

A method is provided for the continuous casting, cutting, and continued heat treatment of steel slabs, particularly those having cracking-prone alloy formulations, without requiring the use of water spray quench cooling equipment.

3 Claims, 4 Drawing Sheets

METHOD FOR SURFACE COOLING STEEL SLABS TO PREVENT SURFACE CRACKING, AND STEEL SLABS MADE BY THAT METHOD

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE DISCLOSURE

1. The Technical Field

The present invention relates to methods for continuous casting of steel slabs.

2. The Prior Art

In conventional continuous casting mills with direct hot charging, steel in a caster assembly is cast into a continuous strand, and passes through a strand containment apparatus in which the steel surface is cooled and the strand changes direction from the vertical to the horizontal. The strand is then conveyed to a severing apparatus where it is severed into slabs, blooms, billets or other products. The slab or other product then enters a reheat furnace for heating to a uniform temperature suitable for downstream rolling and other processing.

It has been widely recognized that it is advantageous to directly charge slabs coming from the caster into the reheat furnace in order to reduce the energy cost associated with reheating slabs that have been cooled to ambient temperature.

In general, problems encountered with plate steel product produced by such continuous casting mills include the tendency for areas around one or more surfaces of the steel product to exhibit brittleness, cracking, sponging, and other surface defects. Surface defects are especially prevalent after the interim steel product is subjected to downstream rolling or other stresses. Although the causes of such surface defects are not completely understood, it has been observed that surface defects tend to occur frequently in steel products having surfaces that are at or above the steel's austenite-to-ferrite transformation start temperature when the product exits the caster assembly, cool to a temperature above the steel's austenite-to-ferrite transformation completion temperature as the product enters the reheat furnace, then are reheated to a temperature above the transformation start temperature when the product is inside the reheat furnace. Steel products that tend to be particularly susceptible to surface defects include low- to high-carbon steels and low-alloy steels, all of which may contain aluminum (Al) and residual elements such as sulphur (S), phosphorus (P), nitrogen (N), and copper (Cu).

While an understanding of the causes of the surface defects is not per se necessary for the practice of the invention, some discussion of the applicant's understanding of the phenomenon may be helpful to the reader. Steel product exiting the caster assembly has a coarse austenite grain structure. As the steel product cools to a temperature above the transformation completion temperature of the metal, various elements including residual elements migrate to the austenite grain boundaries where they will reside as solute elements, or eventually combine to form precipitates. If the steel product has not cooled to below the transformation completion temperature before reheating in the reheat furnace, these elements, in either solute or precipitate form, remain at or near the original austenite grain boundaries. The presence of these elements on grain boundaries and/or the development of precipitate-free zones adjacent to grain boundaries can be detrimental to the ductility of the steel product and may also contribute to the manifestation of one or more types of surface defects. It appears that the principal culprit in many cases is the copper present.

If the interim steel product is taken off-line and left for several hours to cool slowly in still air, the entire product will have completely transformed from coarse-grained austenite to other microconstituents, such as ferrite or pearlite. Reheating this product in a reheat furnace to above the transformation start temperature, (about 900 C. for most steels of interest) the critical temperature above which there is austenite recrystallization, re-transforms the product into fine-grained austenite. It has been found that a product having such a fine-grained austenitic microstructure tends to be free from surface defects. However, such slow cooling requires the product to be taken off-line for an undesirably lengthy period of time, thereby slowing down steel production.

It has been found that instead of re-transforming the entire steel product into fine-grained austenite, it is necessary to re-transform only the surface layers to a suitable depth to achieve a product that is for the most part free of surface defects. However, off-line slow air cooling to achieve a re-transformed layer of sufficient depth requires an undesirably lengthy time.

Previously known methods have been devised in which a slab is taken off-line, immersion-quenched in a quench tank, then returned on-line for transfer into the reheat furnace. In such methods, the temperature of the slab surfaces is often reduced below the transformation completion temperature, i.e. the steel's transformation completion temperature, before the slab is reheated in the reheat furnace. It has been found that an immersion-quenched slab tends to exhibit undesirably inconsistent metallurgical properties along its length. This inconsistency appears to be due to the formation of a lengthwise temperature gradient on the slab prior to its immersion; since the slab is cast from a continuous caster, its downstream portions have had more time to cool than its upstream portions.

One way to reduce the surface temperature, is to quench the surface of the slab with water as it exits the caster. Quenching processes are disclosed in such prior art references as U.S. Pat. No. 5,915,457; U.S. Pat. No. 6,374,901 B1; and U.S. Pat. No. 6,557,622 B2, the complete disclosures of each of which are hereby expressly incorporated herein by reference. The latter two references in particular being directed to methods for differential quenching of the surface of the slabs to address the transverse temperature profile of the slab surfaces.

However, there is a disadvantage to water quenching, in that the casting speed must be restricted to ensure a sufficient depth of the slab has been cooled below a critical temperature, which can negatively impact productivity. Furthermore, certain grades of steel, are susceptible to cracking as a result of the quench, notably vanadium-bearing steels.

It would be desirable to provide a continuous casting process which enjoys the benefits of hot-charging the cut slabs into the reheat furnace to save on energy costs, while avoiding the risks of surface cracking that are associated with water quenching.

This and other desirable characteristics of the invention will become apparent in view of the present specification, including claims, and drawings.

SUMMARY OF THE INVENTION

The present invention comprises, in part, a method for making steel slabs, comprising the steps of:

casting a continuous steel strip in a caster;

severing the continuous strip into discrete slabs;

directing the discrete slabs, successively, to a holding facility;

holding each of the slabs in the holding facility, and releasing them, successively, while exposing the slabs to ambient air temperature; and conveying the slabs successively to a reheat furnace;

the slabs being successively held in and released from the holding facility a sufficient amount of time to cool surface layers of the respective slabs, to a selected depth of penetration so as to transform austenite in the surface of the casting to a non-austenitic microstructure.

The step of holding each of the slabs in the holding facility, and releasing them, successively, while exposing the slabs to ambient air temperature preferably comprises the step of:

moving the slabs along a conveyor path having sufficient length, and at a predetermined speed, such that each of the slabs has attained a desired maximum surface temperature at the time of arrival of that respective slab to the reheat furnace.

The method preferably further comprises the step of affirmatively moving ambient air across the slabs while the slabs are being moved along the conveyor path.

The present invention also comprises a method for making steel slabs, comprising the steps of:

casting a continuous steel strip in a caster;

severing the continuous strip into discrete slabs;

directing the discrete slabs, successively, to a holding facility;

holding each of the slabs in the holding facility, and releasing them, successively, while exposing the slabs to ambient air temperature; and conveying the slabs successively to a reheat furnace;

the slabs being successively held in and released from the holding facility a sufficient amount of time to cool surface layers of the respective slabs, to a maximum temperature of 1200° F.

The present invention also comprises an apparatus for making steel slabs, comprising:

a caster for casting a continuous steel strip;

a severing device for the continuous strip into discrete slabs;

a conveyor for directing the discrete slabs, successively, to a holding facility;

a holding facility for holding each of the slabs in the holding facility, and releasing them, successively, while exposing the slabs to ambient air temperature;

a conveyor for conveying the slabs successively to a reheat furnace;

the slabs being successively held in and released from the holding facility a sufficient amount of time to cool surface layers of the respective slabs, to a selected depth of penetration so as to transform austenite in the surface of the casting to a non-austenitic microstructure.

The holding facility preferably is a conveyor path having sufficient length, for moving the slabs at a predetermined speed, such that each of the slabs has attained a desired maximum surface temperature at the time of arrival of that respective slab to the reheat furnace.

The apparatus preferably further comprises at least one air moving apparatus, operably configured to create a flow of moving ambient air, over the slabs as the slabs move along the conveyor path.

The invention further comprises a method for making steel slabs, comprising the steps of:

casting a continuous steel strip in a caster;

severing the continuous strip into discrete slabs;

directing the discrete slabs, successively, to a holding facility;

holding each of the slabs in the holding facility, and releasing them, successively, while exposing the slabs to ambient air temperature; and conveying the slabs successively to a reheat furnace;

the slabs being successively held in and released from the holding facility a sufficient amount of time to cool surface layers of the respective slabs, to a selected depth of penetration so as to substantially preclude the formation of surface defects in the surface of the casting upon placement of the still substantially above ambient temperature slabs into the reheat furnace.

The invention also comprises steel slabs, made by a method for making steel slabs, the method comprising the steps of:

casting a continuous steel strip in a caster;

severing the continuous strip into discrete slabs;

directing the discrete slabs, successively, to a holding facility;

holding each of the slabs in the holding facility, and releasing them, successively, while exposing the slabs to ambient air temperature; and conveying the slabs successively to a reheat furnace;

the slabs being successively held in and released from the holding facility a sufficient amount of time to cool surface layers of the respective slabs, to a selected depth of penetration so as to transform austenite in the surface of the casting to a non-austenitic microstructure.

Preferably, the step of holding each of the slabs in the holding facility, and releasing them, successively, while exposing the slabs to ambient air temperature further comprises the step of:

moving the slabs along a conveyor path having sufficient length, and at a predetermined speed, such that each of the slabs has attained a desired maximum surface temperature at the time of arrival of that respective slab to the reheat furnace.

The invention also comprises steel slabs, made by a method for making steel slabs, the method comprising the steps of:

casting a continuous steel strip in a caster;

severing the continuous strip into discrete slabs;

directing the discrete slabs, successively, to a holding facility;

holding each of the slabs in the holding facility, and releasing them, successively, while exposing the slabs to ambient air temperature; and conveying the slabs successively to a reheat furnace; the slabs being successively held in and released from the holding facility a sufficient amount of time to cool surface layers of the respective slabs, to a maximum temperature of 1200° F.

DETAILED DESCRIPTION OF DRAWINGS

Figure 1:
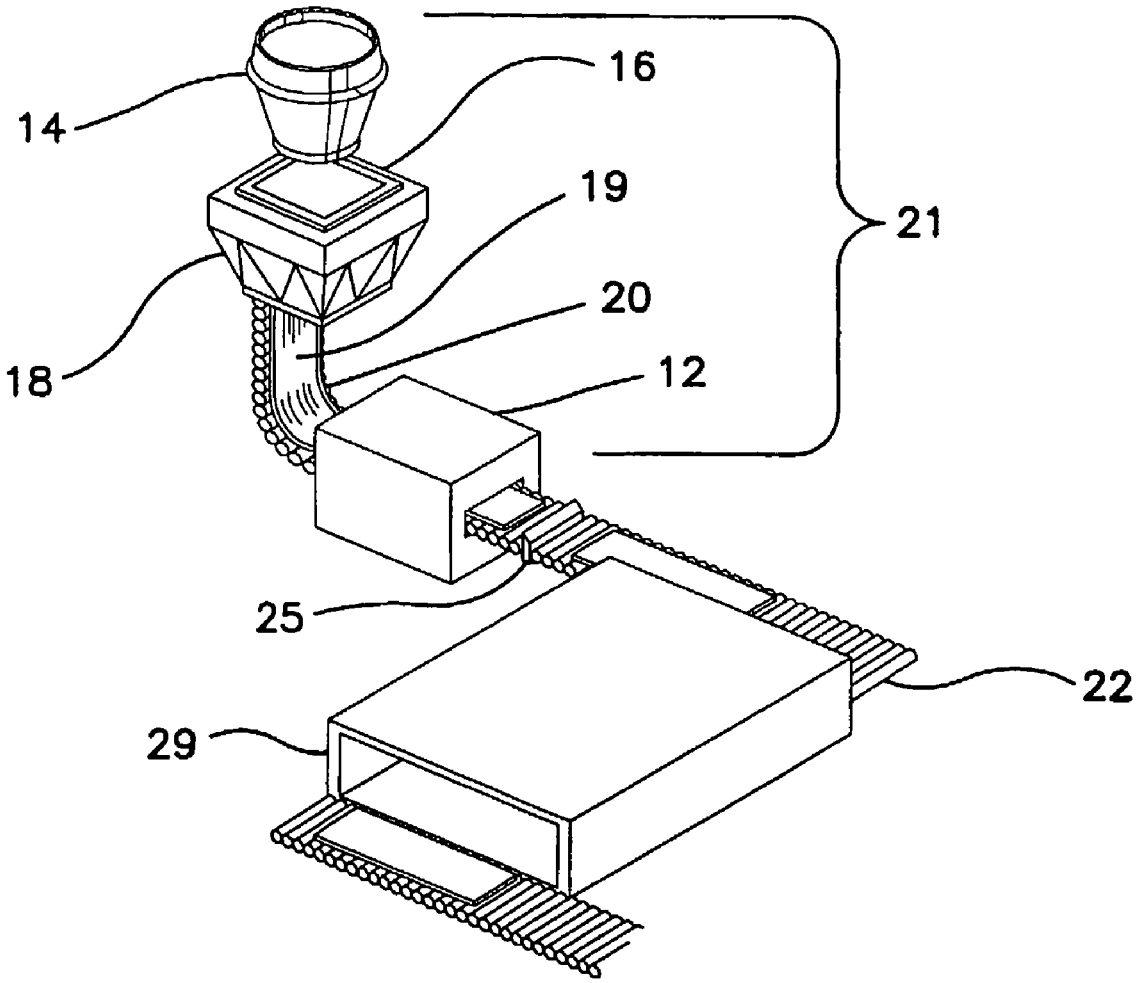
FIG. 1 PRIOR ART
FIG. 1 is a schematic perspective view of a portion of a continuous casting line, including a water quench apparatus, according to a prior art method and apparatus.

While this invention is susceptible of embodiment in many different forms, there is shown in the drawings and will herein be described in detail, a preferred embodiment with the understanding that the present disclosure should be considered as an exemplification of the principles of the invention and is not intended to limit the invention to the embodiment so illustrated.

Figure 2:
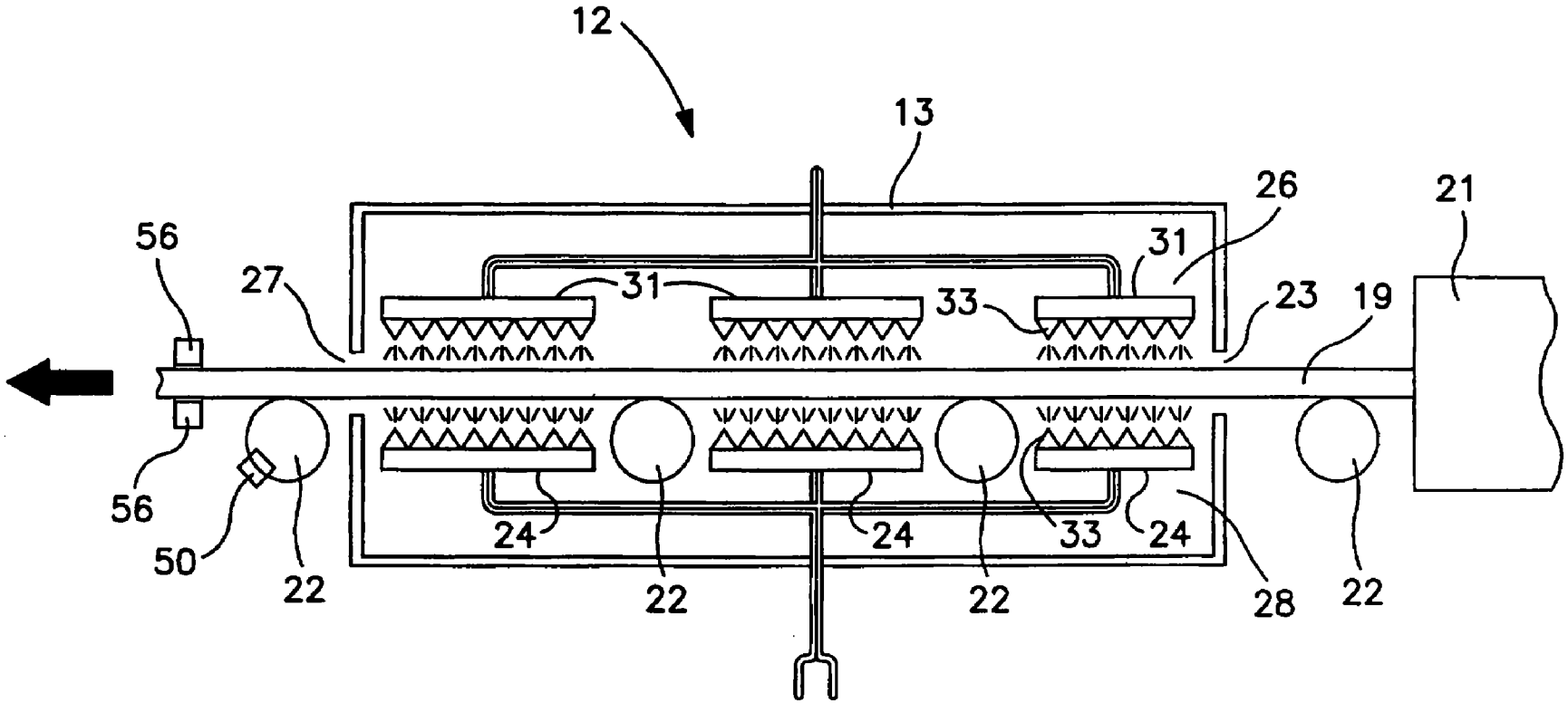
FIG. 2 PRIOR ART
FIG. 2 is a schematic interior side elevation fragment view of an embodiment of the quench apparatus according to the prior art method and apparatus of FIG. 1.

FIGS. 1-2 illustrate a prior art continuous casting facility, in which water quenching is employed. A portion of a casting line of a continuous casting steel facility in which a quench apparatus 12 was installed, is schematically illustrated in FIG. 1. Typically, molten steel was poured from a ladle 14 into a tundish 16 that acts as a temporary reservoir. The molten steel was poured from tundish 16 into a mold 18, which was water cooled so that the surface of the steel passing through the mold 18 solidified to form a continuous thin-skinned strand 19. The strand 19 exited the mold 18 and entered a strand containment and straightening apparatus 20 in which it continued to solidify as it continued to cool, moved arcuately from a generally vertical orientation to a generally horizontal orientation, and was straightened to a horizontal orientation. The devices just described collectively constituted a caster assembly 21.

Referring to FIG. 2, after exiting the caster assembly 21, the strand 19 was conveyed along the conveyor line at the caster speed by a plurality of spaced conveyor rolls (table rolls) 22 (generally, this stage may be referred to as "caster run-out") and was fed into the quench apparatus 12 through a quench apparatus entrance port 23. In this embodiment, the quench apparatus 12 was located immediately downstream of the caster assembly 21 and upstream of a strand severing apparatus 25 (FIG. 1). The quench apparatus 12 had a housing surrounding the strand 19 and confining the quench spray. The strand 19 after being quenched exited the housing via an exit port.

When the strand 19 was conveyed into the quench apparatus 12, selected portions of the strands were quenched by a plurality of intense sprays of water and air combined into an air mist applied by clusters of top spray nozzles 31 and bottom spray nozzles 24. (Air mist tends to be more efficient than water to quench steel.) As a result of the quench, the steel was rapidly cooled from its pre-quench start temperature to a suitable completion temperature so that the steel's microstructure was changed from austenite to one or more suitable microconstituents, such as ferrite or pearlite. Effecting a surface quench to a suitable depth, then reheating the steel in a reheat furnace 29 downstream of the severing apparatus 25, reduced or prevented altogether the occurrence of the surface defects in the steel product. Suitable transformed microstructures include pearlite, bainite, martensite and ferrite, or some combination of two or more of these.

The preferred start temperature was at or above the steel's transformation start temperature and the suitable completion temperature was at or below the steel's transformation completion temperature. Quenching from a start temperature below the transformation start temperature and above the transformation completion temperature was in some cases acceptable but not preferred, as quenching in this temperature range provided some but not as much reduction in the occurrence of surface defects as quenching from a temperature above the transformation start temperature.

The steel transformation start and completion temperatures depended on the type of steel that is cast and the cooling rate. Most types of steel cast in a conventional continuous casting mill were deemed suitable for water quenching; for example, typical plain carbon steels suitable for quenching included steels having 0.03-0.2% carbon content. The cooling rate of a steel product was not constant throughout its body; cooling rates differ at different depths beneath the product surface. Different cooling rates transformed austenite to different combinations of transformation products; as the steel's cooling rate varied with strand depth, the transformed microstructure differed with strand depth. A minimum transformed depth of about ½ to ¾ inch was deemed to satisfactorily reduce the occurrence of surface defects.

The spray nozzle clusters 31, 24 were respectively arranged into a top array 26 and a bottom array 28, wherein each array 26, 28 applied cooling spray to an associated top and bottom surface of the strand 19. Each array 26, 28 was longitudinally aligned and had a series of longitudinal banks 26, 28 arrayed in parallel so as to provide spray coverage to the entirety of the top and bottom surfaces of a maximum-width strand 19.

The appropriate proportions of cooling fluid that was deemed appropriate to be applied respectively to the top and bottom surfaces so that both surfaces were quenched to the same depth were said to be empirically determined by removing test portions of the quenched strand and examining their cross-section. The appropriate proportion could then be programmed into a control system for the quench so that subsequently quenched portions of the strand would be quenched to the required depth.

Referring back to FIG. 1, after the strand 19 had been quenched by the sprays of the quench apparatus 12, the strand 19 exited the quench apparatus 12 and was severed into slabs by the severing apparatus 25. The slabs were then conveyed into the reheat furnace 29, where the quenched portions of the slab were reheated to a temperature at least or above the steel's transformation start temperature, thereby re-transforming the transformed microstructure into austenite. In practice, the slabs were heated beyond the transformation start temperature, to provide a suitable temperature for controlled downstream rolling. It had been found that the austenite formed by this combination of quenching and reheating tended to have a finer grain size than austenite grains of a steel product that had not been quenched before reheating. It had further been found that formation of finer grains of austenite were associated with the reduction in the occurrence of defects in the surface of the eventual steel product.

After quenching, the product was passed into a reheat furnace, where it was heated to a temperature suitable for subsequent downstream processing. In the reheat furnace, each quenched surface layer was reheated to a temperature above the transformation beginning temperature and re-transformed to finer grains of austenite, thereby reducing the occurrence of surface defects on the eventual steel plate product.

However, as indicated hereinabove, this prior art water quenching process and apparatus has some potential drawbacks, in terms of general productivity, as well as potential cracking issues, for cracking-prone grades of steel (which are well-known to those of ordinary skill in the art of steel-making), such as vanadium-bearing grades.

To address those issues, the present invention is directed to an alternative method for cooling the slabs, in order to lower their surface temperature to a sufficient depth, to resist cracking, while still enabling hot-charging of the slabs into the reheat furnace.

In particular, vanadium-bearing steels are not water quenched, due to the particularly slow rate of quenching required to prevent the crack-prone material from developing surface cracks during the quench. Instead, vanadium bearing steels are typically allowed to air-cool for twenty-four hours, once cut into slabs, prior to charging to the reheat furnace. This process requires substantially more heat energy to be expended, to bring the substantially cooled slabs up to the desired reheat temperature, as compared to the water quench and direct hot-charging process described with respect to FIGS. 1-2 herein.

It has been determined that brief cooling the slabs with ambient temperature air can enable hot-charging of the reheat furnace, without requiring the expensive and complex water quench system, of the prior art, as described and shown in FIGS. 1-2.

Figure 3:
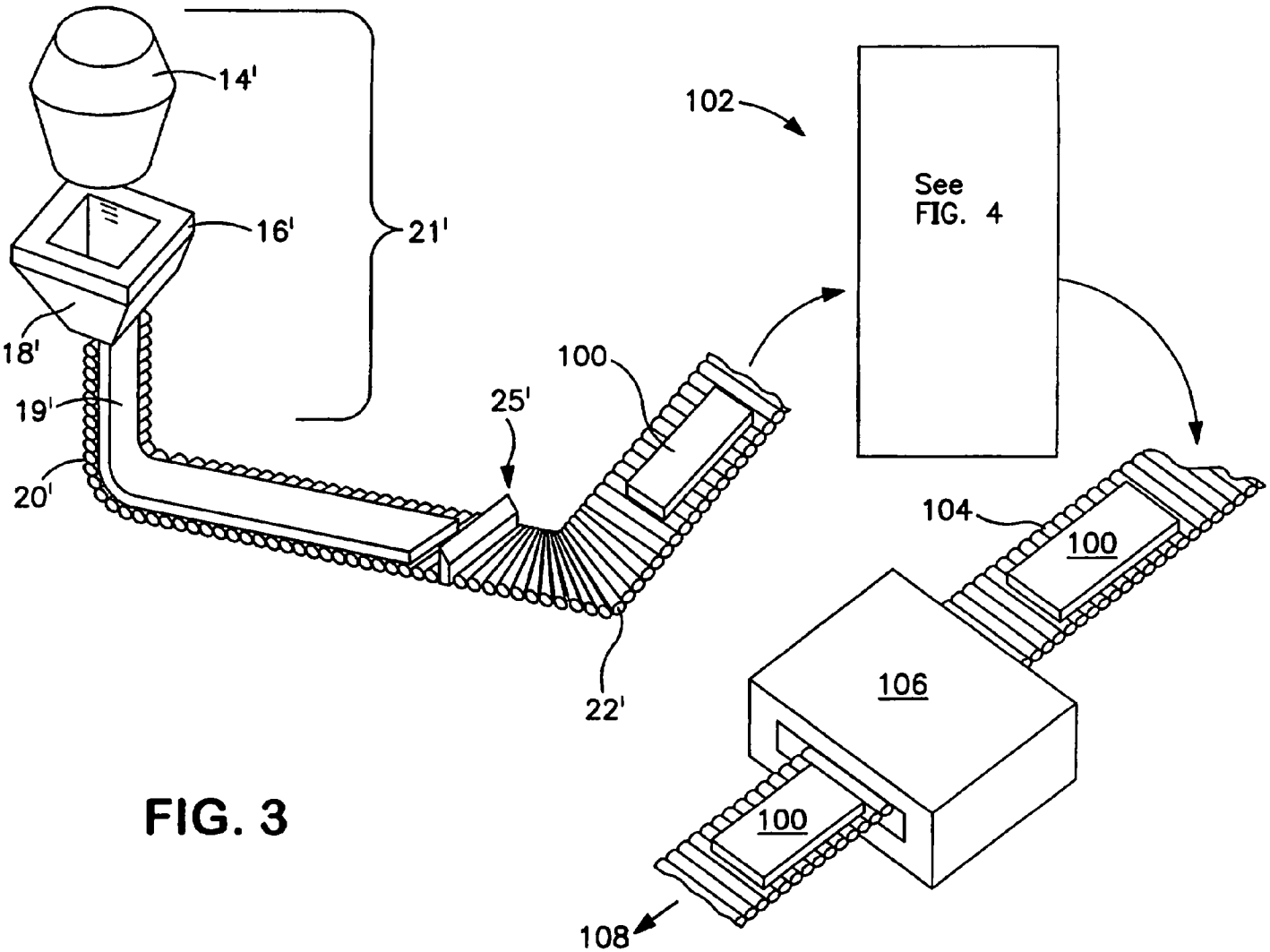
FIG. 3 is a schematic illustration of an apparatus for air-cooling of slabs, for using the method of the present invention.
Figure 4:
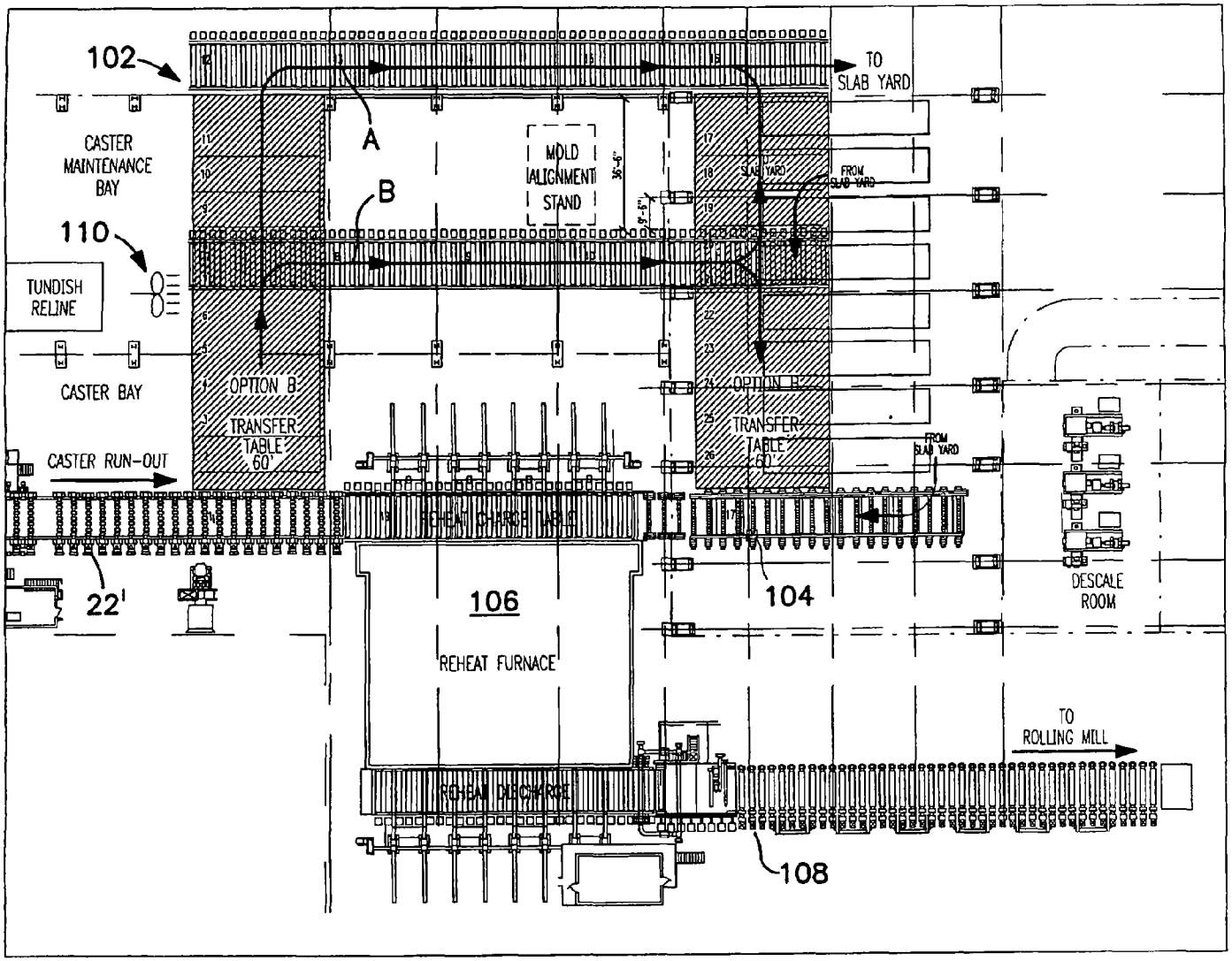
FIG. 4 is a more detailed illustration of portions of the apparatus of FIG. 3, focusing on the slab "walk-around" conveyor system for achieving air-cooling.

The method and apparatus of the present invention, is illustrated schematically in FIG. 3, and in further detail in FIG. 4, which overlaps, to some extent, FIG. 3. The method of the present invention incorporates a ladle 14' into a tundish 16' that acts as a temporary reservoir. The molten steel is poured from tundish 16' into a mold 18', which is water cooled so that the surface of the steel passing through the mold 18' solidifies to form a continuous thin-skinned strand 19'. The strand 19' exits the mold 18' and enters a strand containment and straightening apparatus 20' in which it continues to solidify as it continues to cool, moves arcuately from a generally vertical orientation to a generally horizontal orientation, and is straightened in its horizontal orientation. The devices just described collectively constitute a caster assembly 21'. The strand 19' is then severed by severing apparatus 25' (which may be a mechanical cutting device or a flame cutting device, or other suitable severing device known to those of ordinary skill in the art). The portion of the path immediately downstream of the caster assembly 21' may be referred to as the caster run-out.

After the strand 19' is severed into slabs 100, they are transported by roller conveyor 22', to a holding facility 102 (see FIG. 4), which is sized sufficiently to absorb slabs 100, e.g., in a planar loop or loops, so that the slabs 100 are maintained in a preferably slowly continuously moving queue, to successively hold, and release the slabs 100 at a rate that will enable the incoming slabs 100 to be taken in, without "backing up" and slowing the casting rate, while at the same time permitting the slabs to cool sufficiently to be returned to downstream conveyor 104, and thence on to reheat furnace 106, and then to subsequent processing, as desired.

The shape, construction and configuration of the holding facility 102 may be of any suitable format. In prior art casting installations, typically slabs have been taken "off-line" to a slab yard, for long-duration holding of slabs (such as for the twenty-four hour holding described above) and sometimes stacked, because there was insufficient floor space to enable the slabs to be spread out.

Holding facility 102, in an embodiment of the invention, may comprise one or more conveyor paths, such as paths A (most preferred) and B of FIG. 4. Note that any numerical physical dimensions provided in FIG. 4 are given by way of example, and the invention is not intended to be limited thereby. Holding facility 102 includes two paths which may be used in combination, for example where slabs may be, for short periods of time, precluded from leaving holding facility 102, because of temporary lack of availability of reheat furnace 106 or other delaying factors. In addition, holding facility 102 does contain the option of allowing slabs to be moved to the slab yard, for exceptional circumstances, such as the observation of surface defects on the slabs, extended unavailability of downstream facilities, etc.

Preferably, the casting facility, and more particularly, the holding facility, will be situated so that the air temperatures ambient to the holding facility will be, on average, 20° C. to 25° C. Because the typical casting facility will be constructed to be exposed to outside air through large doors, the air temperatures in the vicinity of the holding facility may have seasonal variations, from 0° C. in winter to 45° C.-50° C. in summer (depending also upon the geographic location of the casting facility in general).

A typical casting strand may have an initial thickness of 6 inches, which is subsequently rolled down to 1.25-1.5 inches in thickness, and will have a more or less constant width, during rolling, of approximately 73 inches. These dimensions are given by way of example, and the scope of the invention is in no way intended to be limited thereto. At the time and location of the cut (e.g., by torch) into slabs, each slab may have surface temperatures of from about 1550° F. to about 1900° F. or greater, and a substantially higher core temperature. The temperatures coming off the initial casting are, as indicated hereinabove, highly non-uniform throughout the surface and volume of each slab. It is believed for a slab of such characteristics, that it should be cooled to a surface temperature of 1200° F. or less (e.g., 1150° F. to provide a further margin of safety) to have cooling to a sufficient depth to enable hot direct charging to the reheat furnace while substantially eliminating surface cracking or other surface defects.

It has been found that a cooling time for such slabs, when placed in a holding facility can be in the range of 60 to 90 minutes, and achieve the desired degree of surface cooling, even with a casting rate of 50 inches per minute. Increases in initial temperatures will, of necessity, increase the time that the slabs must loiter in the holding facility before being moved on to the reheat furnace. Those of ordinary skill in the art can determine, from simple calibration tests, the required increase in holding time, or less preferably, reduction in casting speed, which would affect the desired cooling. Conversely, reductions in the temperatures of the slabs reduces the holding time between slab cut and reheat furnace charge. Variations in slab dimensions, from those discussed, may also have some effect on cooling times, though not as large an effect as variations in initial slab temperatures, inasmuch as it is the achievement of necessary cooling to a particular depth which is important (which may be more or less independent of the overall thickness of the slab being cooled).

As mentioned above, a preferred embodiment of the method incorporates the use of a planar track comprising one or more loops or alternative paths, to hold the slabs during their ambient air cooling period.

The holding facility may also be provided with one or more air fans (e.g., fan 110), or other air conditioning devices, which may be placed at various locations around the path of the slabs in holding facility 102, to keep the air moving around the slabs in the holding facility. This is particularly beneficial, in that it is well known that in metal casting installations, in the absence of devices to move air along, air temperatures can be substantially elevated.

Although stacking of the slabs might be considered as an alternative means for enabling the slabs to loiter in between the caster run-out and the reheat furnace, in general, stacking is considerably less preferred, as the proximity of the slabs to one another tends to slow the rate of cooling, making the air-cooling process less efficient. A stacking structure might be incorporated into the overall conveyor system for permitting stacking of the slabs, for brief periods of time, in the event of rare occasional occurrences when the reheat furnace might not be clear to receive cooled slabs.

The foregoing description and drawings merely explain and illustrate the invention, and the invention is not so limited as those skilled in the art who have the disclosure before them will be able to make modifications and variations therein without departing from the scope of the invention.

What is claimed is:

1. A method for making steel slabs, comprising the steps of:

casting a continuous steel strip in a caster;

severing the continuous strip into discrete slabs, each of the slabs having a surface temperature in excess of the austenite-to-ferrite transformation completion temperature of the steel;

moving the slabs from the caster to a reheat furnace along at least one continuous conveyor path from amongst a plurality of alternative continuous conveyor paths, all of which lead to the reheat furnace and convey the slabs from the caster to the reheat furnace, without removing the slabs from the conveyor path, while exposing the slabs to ambient air temperature, the at least one conveyor path having a sufficient length and predetermined speed to ensure that only the surface layers of the respective slabs cool enough through a selected depth of penetration to transform from an austenite microstructure, to ensure that substantially less than the entirety of each of the respective slabs transforms from its austenite microstructure prior to introduction into the reheat furnace, the surface layers of the respective slabs cooling to a maximum temperature of about 1200° F. as a result of said movement along said at least one continuous conveyor path; and conveying the slabs successively to and into the reheat furnace.

2. The method according to claim 1 wherein the length and the predetermined speed of the at least one conveyor path are such that only the surface layers of the respective slabs cool to a temperature of about 1150° F.

3. The method according to claim 1, further comprising the step of affirmatively moving ambient air across the slabs while the slabs are being moved along the at least one conveyor path.

* * * * *